United States Patent [19]

Baricos et al.

[11] Patent Number: 4,718,347

[45] Date of Patent: Jan. 12, 1988

[54] PRESSURE PLATE FOR MINES, IN PARTICULAR ANTI-TANK MINES, AND MINE COMPRISING SAME

[75] Inventors: Jean Baricos, Ramonville St Agne; Denis Dilhan, Auterive, both of France

[73] Assignee: Etienne LaCroix Tous Artifices S.A., France

[21] Appl. No.: 6,950

[22] Filed: Jan. 27, 1987

[30] Foreign Application Priority Data

Jan. 29, 1986 [FR] France ..... 86 01238

[51] Int. Cl.[4] ..... F42B 23/28

[52] U.S. Cl. ..... 102/428

[58] Field of Search ..... 102/428, 429, 401, 402

[56] References Cited

U.S. PATENT DOCUMENTS

| | | | |
|---|---|---|---|
| 2,790,387 | 4/1957 | Billon | 102/428 |
| 3,282,212 | 11/1966 | Romano | 102/428 |
| 4,476,784 | 10/1984 | Reynes | 102/428 |

FOREIGN PATENT DOCUMENTS

| | | | |
|---|---|---|---|
| 541705 | 10/1955 | Belgium . | |
| 94466 | 11/1983 | European Pat. Off. . | |
| 2357860 | 2/1978 | France | 102/428 |
| 2504254 | 10/1982 | France | 102/428 |

*Primary Examiner*—Charles T. Jordan

*Attorney, Agent, or Firm*—Quarles & Brady

[57] ABSTRACT

A pressure plate for a mine comprises a hydraulic circuit. The mine is triggered by complete depression of the pressure plate. The hydraulic circuit comprises a pressure chamber containing a fluid that is compressed by a force applied to the pressure plate. The fluid is evacuated from the pressure chamber in a controled manner through a depressurization unit in response to a sustained force greater than a predetermined threshold being applied to the pressure plate. A bistable member moves between a first position in which it prevents communication between the pressure chamber and the depressurization unit and a second position in which it establishes communication between the pressure chamber and the depressurization unit. The bistable member is initially in the first position when no force is exerted on the pressure plate. It remains in the first position so long as the pressure plate is subjected to an increasing or stable force. It switches to the second position when the pressure of the fluid decreases after it has increased due to a force of this kind. Thus, after increasing to a maximum value and then decreasing to a minimum value, any increase in the force results in depressurization of the fluid and complete depression of the pressure plate. This explodes the mine.

16 Claims, 5 Drawing Figures

PRESSURE PLATE FOR MINES, IN PARTICULAR ANTI-TANK MINES, AND MINE COMPRISING SAME

BACKGROUND OF THE INVENTION

1. Field of the Invention

The present invention concerns a pressure plate for mines, in particular anti-tank mines.

It also concerns a mine comprising a pressure plate of this kind.

2. Description of the prior art

A mine of this kind comprises an operational pyrotechnic charge enclosed in an enveloping body having in its upper part a so-called "pressure plate" adapted, when it is completely depressed, to release a striker which initiaes an ignitor pyrotechnic charge for the operational pyrotechnic charge.

Mines of this kind are described, for example, in French patents Nos. 2 357 860 and 2 504 254 in the name of the assignees of the present applicants.

In this instance the pressure plate cooperates with a countermeasures hydraulic circuit comprising a pressure chamber containing a fluid that is compressed by the force exerted on the plate and evacuated in a controled manner by a depressurization unit, such as a calibrated orifice, for example, in response to a sustained force exceeding a predetermined threshold being applied to the plate.

The depressurization unit thus slows down the depression of the plate so that complete depression of it will always require a sustained force to be applied to it for a certain time interval, exceeding the duration of the blast from an explosion but less than the time taken for a track roller of a moving tank to pass over it.

Although a device of this kind constitutes an effective countermeasure against explosive methods of mine clearing ("anti-blast" countermeasure) it is nevertheless ineffective against other mine clearing techniques that may be employed to open up a breach in a minefield, especially use of a tank fitted with a mine clearing roller: the force exerted by the roller on the pressure plate is in all respects comparable with that exerted by a tank track roller and conventional mines do not currently incorporate any countermeasure to this type of operation.

One objective of the invention is to propose a new countermeasure device for mine pressure plates whereby the mine is triggered not in response to an initial sustained force applied to the plate (which could correspond to a mine clearing roller passing over it) but only to a second sustained force sensed by the pressure plate.

This type of countermeasure has the further advantage of delaying triggering of the mine, when a tank passes directly over it, until the second roller passes over the mine; this contributes to enhancing the destructive effect of the mine.

SUMMARY OF THE INVENTION

In one aspect, the present invention consists in a pressure plate for a mine adapted to be triggered by complete depression of the pressure plate, which incorporates a hydraulic circuit comprising a pressure chamber containing a fluid that is compressed by force applied to the pressure plate, a depressurization unit through which the fluid is evacuated from the pressure chamber in a controled manner in response to a sustained force greater than a predetermined threshold being applied to the pressure plate, and a bistable member adapted to move between a first position in which it prevents communication between the pressure chamber and the depressurization unit and a second position in which it establishes communication between the pressure chamber and the depressurization unit, the arrangement being such that the bistable member is initially in the first position when no force is exerted on the pressure plate and remains in the first position so long as the pressure plate is subjected to an increasing or stable force and switches to the second position when the pressure of the fluid decreases after it has increased due to a force of this kind whereby, after increasing to a maximum value and then decreasing to a minimum value, an increase in the force results in depressurization of the fluid and complete depression of the pressure plate, so triggering the mine.

In another aspect, the present invention consists in a mine comprising a pressure plate as defined in the preceding paragraph.

The bistable member disposed between the pressure chamber and the depressurization unit is responsive to pressure information transmitted by the fluid compressed by the pressure plate and, on the second pressure pulse, initiates opening of the hydraulic circuit towards the depressurization unit, which enables complete depression of the plate and initiation of the pyrotechnic system of the mine.

It should be noted that this principle of operation does not entail the plate returning to its initial position by virtue of a retrograde movement.

The change from the first position to the second position of the bistable member is preferably irreversible.

In one specific embodiment the pressure chamber comprises two pistons a first of which is adapted to be initially in contact with a surface of the mine underlying the pressure plate, whereby the fluid is pressurized immediately depression of the pressure plate commences, and the second of which is adapted to come into contact with this surface after the pressure plate has been depressed by a predetermined distance.

In this case, the two pistons define respective chambers within the pressure chamber, which may be concentric with each other, and communication is established between the two chambers by calibrated orifice means: this makes it possible to insert a time-delay on initial depression of the plate to provide a countermeasure against explosive mine clearing operations as the blast from an explosion, extremely violent but also of extremely short duration, is not able to produce complete depression of the pressure plate because of the time-delay governing hydraulic transfer between the two chambers.

The pressure plate preferably further comprises a break-off member adapted to fracture when the force applied to the pressure plate reaches a predetermined threshold and adapted to prevent depression of the pressure plate by the predetermined distance before it fractures.

In one specific embodiment the bistable member comprises a slide-valve distributor devlce, which has a direct action input and a reverse action input, and the pressure plate assembly further comprises a check valve whereby the direct action input is connected to the pressure chamber, the reverse action input being connected directly to the pressure chamber, whereby an increasing pressure in the pressure chamber does not displace the slide-valve because the pressure at each of the inputs is the same and a subsequent decrease in the pressure in the pressure chamber moves the slide-valve towards the second position because of the difference between the pressures at the two inputs.

In this case, the pressure plate advantageously further comprises a pressure accumulator connected to the direct action input of the distributor device and adapted to store pressure energy when the pressure is increasing and to restore this pressure energy when the pressure subsequently decreases.

Finally, it is possible to provide a plurality of bistable members in series with each other, rather than a single bistable member, so that the mine is triggered not by a second application of pressure but by a third, fourth, etc application of pressure.

Other characteristics and advantages of the invention will emerge from the following detailed description of one embodiment given with reference to the appended drawings.

DESCRIPTION OF THE PREFERRED EMBODIMENT

Figure 1:
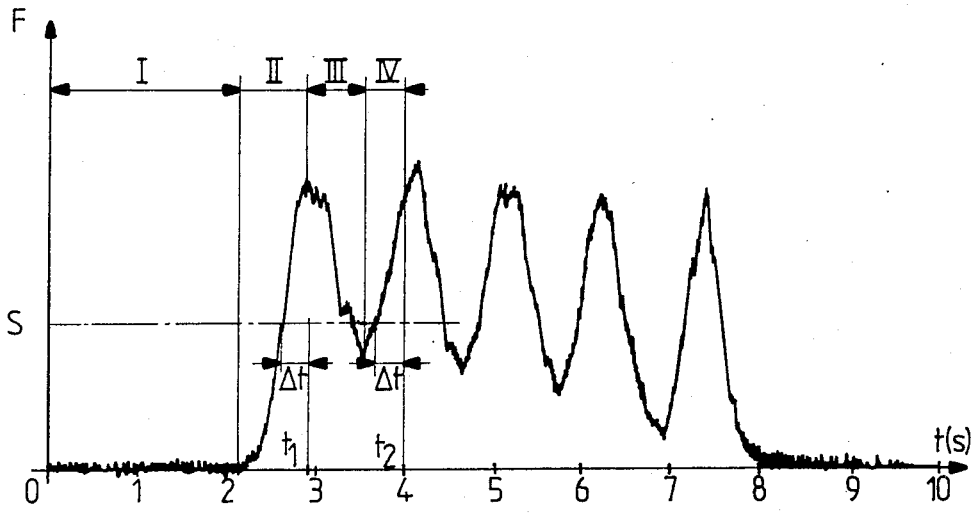
FIG. 1 is a graph showing as a function of time the force exerted at a point on the ground as a moving tank passes over it.

FIG. 1 shows the variation as a function of time in the force F applied to a point on the ground - and thus to the pressure plate of a mine - when a vehicle passes over it, in this example a tank travelling at 2.4 kph.

In this example, as in all cases concerning a tracked vehicle, the curve features a plurality of peaks corresponding to the successive rollers passing over the point in question.

A conventional type mine would explode at time $t_1$ determined by two parameters S and $\Delta t$.

For depression of the pressure plate of the mine to begin a force threshold S has to be exceeded. The threshold may be set, for example, by a valve held closed by acalibrated spring that will not begin to open and so allow the fluid compressed by the pressure plate to escape until the pressure of the fluid exceeds a particular value.

To prevent triggering of the mine in response to the blast from an explosion there is provided a time-delay $\Delta t$, which is the minimum duration taken by the pressure plate to become completely depressed and so release the striker. This time-delay may be defined, for example, by a calibrated orifice in series with the depressurization valve, limiting the fluid flowrate and thus the time taken to depress the pressure plate.

However, if mine clearing is conducted not by explosive means but by means of a mine clearing roller the mine triggering mechanism could not distinguish between the mine clearing roller and the first roller of a tank, since the variations in the force applied to the pressure plate would be substantially the same.

The system of the invention therefore proposes to trigger the mine not at time $t_1$ (since it is not possible to tell whether this first peak corresponds to the first roller of a tank or a mine clearing roller passing over the mine) but rather at time $t_2$, meaning when the force increases again following a change through a maximum force (the first peak) and then a minimum force.

Figure 2:
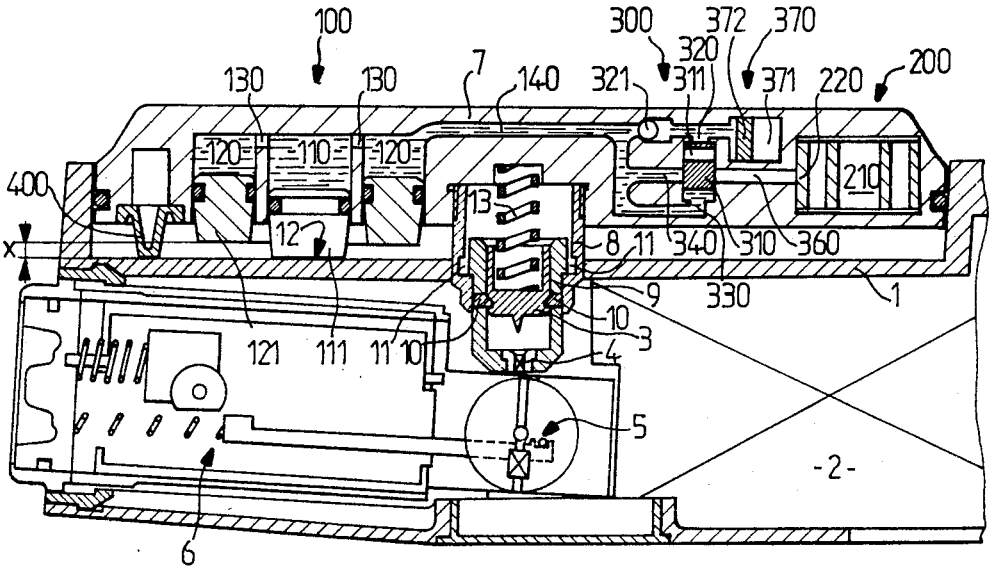
FIG. 2 shows in cross-section the structure of the mine and in particular of the pressure plate and the associated countermeasure device, in an initial state.

FIG. 2 shows in cross-section a typical mine structure whereby this function may be implemented, the mine being shown in its initial state (phase I in FIG. 1).

Apart from the hydraulic circuit incorporated in the pressure plate, the general structure of the mine is in all respects comparable with that as described in the previously mentioned French patents No. 2 357 860 and 2 504 254, the contents of which are herein incorporated by way of reference. Briefly, the mine comprises a casing 1 containing an operational pyrotechnic charge 2 adapted to be ignited by the release of a striker 3: once released, the striker strikes a primer 4 which initiates a pyrotechnic firing and fire transmission chain 5 which triggers the explosion; the chain 5 is adapted to be aligned by a time-delay device 6 such as a clockwork type time-delay device as described in French Patent No. 2 504 254.

The striker 3 is released on complete depression of the pressure plate 7 into the upper part of the casing 1. The plate is fastened to an outer sleeve 8 that slides on a fixed inner sleeve 9. The fixed sleeve 9 accommodates keys 10 which hold back the striker 3. In the initial position shown in FIG. 2 the keys are immobilized by the lower part of the outer sleeve 8, which further comprises openings 11 in its upper part; when the combination of the pressure plate and the outer sleeve is depressed the openings 11 come into line with the keys 10 (see FIG. 5) and so release the striker 3 which is impelled by the spring 13 into contact with the primer 4 and so explodes the mine.

The object of the hydraulic circuit contained in the pressure plate is to bring about depression of the plate in a controled way conditioned by the applied force.

The hydraulic circuit comprises a pressure chamber 100 containing an appropriate fluid, for example an incompressible liquid such as oil (this choice is in no way of a limiting nature, however, and other fluids may equally well be used, in liquid or even in gaseous form).

The pressure chamber comprises a central chamber 110 closed off at the bottom by a movable piston 111 the bottom surface of which is in contact with the upper surface 12 of the casing 1; this inner chamber 110 is surrounded by an annular chamber 120 closed by an annular piston 121 that is not in contact with the surface 12, but rather spaced from it by a distance x.

Communication is established between the chambers 110 and 120 by calibrated orifices 130, the chamber 120 communicating with the remainder of the hydraulic circuit through a connecting passage 140. The remainder of the hydraulic circuit comprises a depressurization unit 200 of conventional type and a control unit 300, characteristic of the invention, disposed between the pressure chamber 100 and the depressurization unit 200.

The depressurization unit 200 comprises a depressurization chamber 210 closed by a calibrated spring-loaded valve 220. In the conventional way the calibrated valve 220 slows down the flow of fluid into the depressurization chamber, so inserting a certain time-delay to create an "anti-blast" countermeasure.

It should be noted that it is not essential for the fluid to flow into a closed chamber provided within the pressure plate in order to secure depressurization; the fluid could instead flow directly to the exterior.

The control unit 300 disposed between the pressure chamber 100 and the depressurization unit 200 initially prevents any communication between these two parts of the circuit.

This unit comprises a slide-valve distributor device 310 incorporating a passage 311. The input 320 of the distributor device (which will be hereinafter referred to as the "direct action input", as it is this input which causes the slide-valve to move to the position in which it opens the circuit) is connected to the passage 140 communicating with the pressure chamber 100 through a check valve 321 preventing flow of fluid from the distributor device to the pressure chamber but permitting it to flow in the opposite direction.

The opposite input 330 (hereinafter called the "reverse action input") is directly connected to the passage 140.

The inlet passage 340 of the distributor device is connected to the passage 140 communicating with the pressure chamber and its outlet passage 360 is connected to the depressurization chamber 210.

There is also provided, in communication with the direct action input 320, a pressure accumulator 370 comprising a chamber 371 containing a compressible gas (air, for example) closed off by a movable piston 372.

Between the lower surface of the pressure plate 7 and the upper surface 12 of the casing there is disposed a break-off member 400, for example a break-off peg or a plurality of break-off pegs arranged around the periphery, preventing any depression of the plate so long as the force exerted on it remains below a particular threshold. Once this threshold has been exceeded the fractured break-off element 400 no longer has any operative function.

Figure 3:
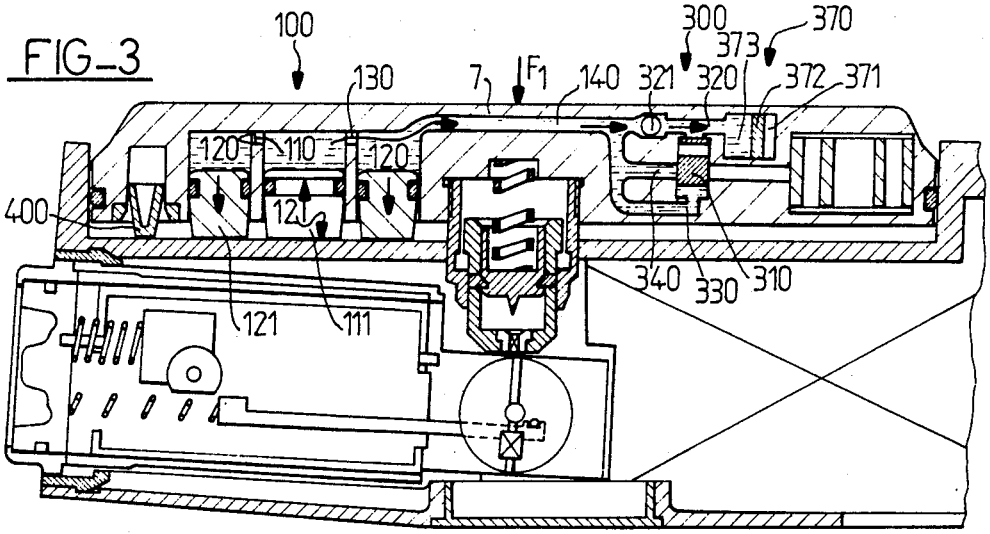
FIG. 3 shows the same mine when force is first applied to the pressure plate.
Figure 4:
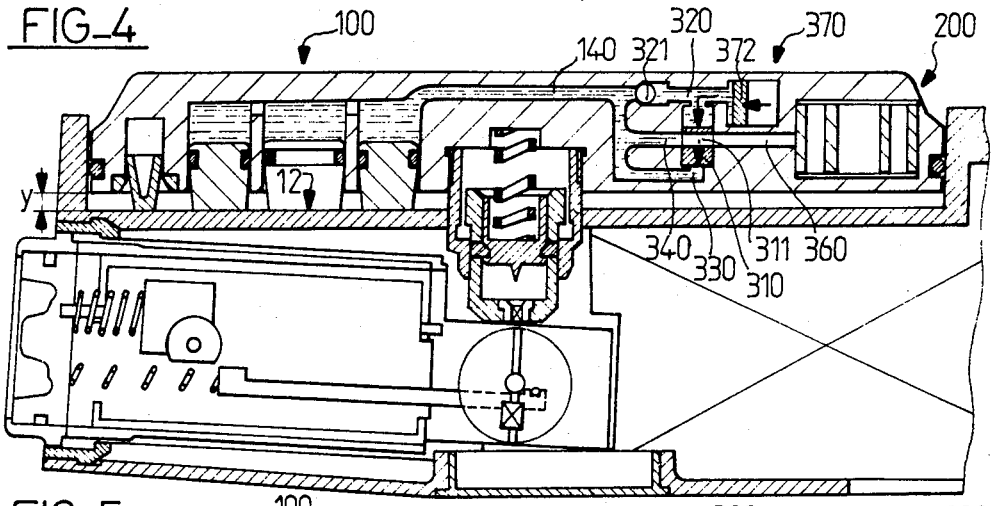
FIG. 4 shows the same mine immediately after this first force has been removed.

The operation of the mine will now be described with reference to FIGS. 3 through 5. The pressure plate being in its initial position (that shown in FIG. 2), an increasing force applied to the plate (area II in FIG. 1) will fracture the break-off pegs 400 when the corresponding threshold (1 500 N, for example) is exceeded.

Depression of the plate is then possible and the piston 111 compresses the fluid contained in the central chamber 110; the fluid is expelled through the calibrated orifices 130 into the annular chamber 120 where the resulting increase in pressure pushes down the annular piston 121. Because of the time-delay introduced by the calibrated orifices 130 an "anti-blast" countermeasure is operative.

When the pressures in the two chambers 110 and 120 have equalized, the two pistons 111 and 121 are both in contact with the upper surface 12 of the casing and thus behave as a single piston.

During displacements of the pistons the increasing pressure is communicated to the control unit 300 through the passage 140. As the check valve 321 is open, the same pressure is applied to the direct and reverse action inputs of the distributor device, with the result that the position of the slide-valve 310 does not change.

Because of the reduction in the volume of the pressure chamber 100 the compressed fluid is discharged towards the accumulator device 370 the chamber 373 of which increases in volume and pushes back the piston 372, so compressing the air in the chamber 371.

At the end of this increasing force stage, when the peak force has been exceeded and the force is beginning to decrease (area III in FIG. 1 and figure 4), the pressure in the pressure chamber 100 decreases and the pressure at the reverse action input of the distributor, which is directly connected to the pressure chamber, therefore decreases.

However, the pressure at the direct action input cannot decrease because of the obstruction consisting in the check valve 321, which closes immediately the pressures in the remainder of the circuit decreases. This difference between the pressure at the two inputs will cause the slide-valve 310 to move so that the passage 311 becomes aligned with the inlet passage 340 and the outlet passage 360 of the distributor device. Direct communication is then irreversibly established between the pressure chamber 100 and the depressurization unit 200.

It should be noted that the displacement of the slide-valve is assisted by the restored energy from the accumulator device 370 the piston 372 of which expells the fluid initially contained in the chamber 373 (figure 3) towards the direct action input of the distributor device (FIG. 4), the volume of fluid displaced corresponding to that needed to displace the slide-valve 310 completely.

In this position, even if the force decreases, the piston will remain in its intermediate depressed state, that is to say a distance y from the upper surface 12 of the casing.

Figure 5:
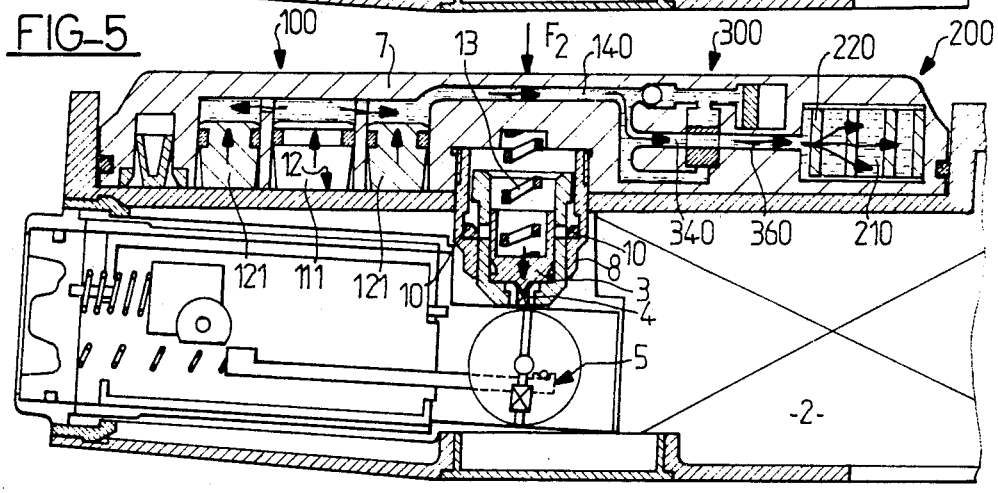
FIG. 5 shows the same mine when a second force is applied.

The mine now behaves as a conventional pressure plate type mine: when the force increases (area IV in FIG. 1) the depression of the pistons 111 and 121 expells the fluid towards the depressurization unit via the calibrated valve 220 (FIG. 5).

The fluid will then be expelled from the pressure chamber 100 to the depressurization unit 220 through the passages 140, 340 and 360, the control unit 300 by now being definitively inoperative.

The countermeasure against explosive mine clearing is essentially implemented by the check valve 220 which imposes a passage of reduced cross-section for the fluid at the inlet to the depressurization unit. This imposes a limitation on the travel in response to a short duration pulse with a sharply rising edge, corresponding to an explosive mine clearing blast.

At the end of movement of the plate the striker 3 is released and initiates the pyrotechnic chain, so exploding the mine.

We claim:

1. Pressure plate for a mine adapted to be triggered by complete depression of the pressure plate, which incorporates a hydraulic circuit comprising a pressure chamber containing a fluid that is compressed by force applied to the pressure plate, a depressurization unit through which said fluid is evacuated from said pressure chamber in a controled manner in response to a sustained force greater than a predetermined threshold being applied to the pressure plate, and a histable member adapted to move between a first position in which it prevents communication between said pressure chamber and said depressurization unit and a second position in which it establishes communication between said pressure chamber and said depressurization unit, the arrangement being such that said bistable member is initially in said first position when no force is exerted on the pressure plate and remains in said first position so long as the pressure plate is subjected to an increasing or stable force and switches to said second position when the pressure of said fluid decreases after it has increased due to a force of this kind whereby, after increasing to a maximum value and then decreasing to a minimum value, an increase in said force results in depressurization of said fluid and complete depression of the pressure plate, so triggering the mine.

2. Pressure plate according to claim 1, wherein the change from said first position to said second position of said bistable member is irreversible.

3. Pressure plate according to claim 1, wherein said pressure chamber comprises two pistons a first of which is adapted to be initially in contact with a surface of the mine underlying the pressure plate, whereby said fluid is pressurized immediately depression of the pressure plate commences, and the second of which is adapted to come into contact with said surface after the pressure plate has been depressed by a predetermined distance.

4. Pressure plate according to claim 3, wherein said two pistons define respective chambers within said pressure chamber and further comprising calibrated orifice means whereby communication is established between said two chambers.

5. Pressure plate according to claim 4, wherein said two chambers are concentric.

6. Pressure plate according to claim 3, further comprising a break-off member adapted to fracture when the force applied to the pressure plate reaches said predetermined threshold and adapted to prevent depression of the pressure plate by said predetermined distance before it fractures.

7. Pressure plate according to claim 1, wherein said bistable member comprises a slide-valve distributor device, which has a direct action input and a reverse action input, and further comprising a check valve whereby said direct action input is connected to said pressure chamber, said reverse action input being connected directly to said pressure chamber, whereby an increasing pressure in said pressure chamber does not displace said slide-valve because the pressure at each of said inputs is the same and a subsequent decrease in the pressure in said pressure chamber moves said slide-valve towards said second position because of the difference between the pressures at said two inputs.

8. Pressure plate according to claim 7, further comprising a pressure accumulator connected to said direct action input of said distributor device and adapted to store pressure energy when said pressure is increasing and to restore said pressure energy when said pressure subsequently decreases.

9. Mine comprising a pressure plate and adapted to be triggered by complete depression of the pressure plate, which incorporates a hydraulic circuit comprising a pressure chamber containing a fluid that is compressed by force applied to the pressure plate, a depressurization unit through which said fluid is evacuated from said pressure chamber in a controled manner in response to a sustained forc greater than a predetermined threshold being applied to the pressure plate, and a bistable member adapted to move between a first position in which it prevents communication between said pressure chamber and said depressurization unit and a second position in which it establishes communication between said pressure chamber and said depressurization unit, the arrangement being such that said bistable member is initially in said first position when no force is exerted on the pressure plate and remains in said first position so long as the pressure plate is subjected to an increasing or stable force and switches to said second position when the pressure of said fluid decreases after it has increased due to a force of this kind whereby, after increasing to a maximum value and then decreasing to a minimum value, an increase in said force results in depressurization of said fluid and complete depression of the pressure plate, so triggering the mine.

10. Mine according to claim 9, wherein the change from said first position to said second position of said bistable member is irreversible.

11. Mine according to claim 9 wherein said pressure chamber comprises two pistons a first of which is adapted to be initially in contact with a surface of the mine underlying the pressure plate, whereby said fluid is pressurized immediately depression of the pressure plate commences, and the second of which is adapted to come into contact with said surface after the pressure plate has been depressed by a predetermined distance.

12. Mine according to claim 11, wherein said two pistons define respective chambers within said pressure chamber and further comprising calibrated orifice means whereby communication is established between said two chambers.

13. Mine according to claim 12, wherein said two chambers are concentric.

14. Mine according to claim 11, further comprising a break-off member adapted to fracture when the force applied to the pressure plate reaches said predetermined threshold and adapted to prevent depression of the pressure plate by said predetermined distance before it fractures.

15. Mine according to claim 9, wherein said bistable member comprises a slide-valve distributor device, which has a direct action input and a reverse action input, and further comprising a check valve whereby said direct action input is connected to said pressure chamber, said reverse action input being connected directly to said pressure chamber, whereby an increasing pressure in said pressure chamber does not displace said slide-valve because the pressure at each of said inputs is the same and a subsequent decrease in the pressure in said pressure chamber moves said slide-valve towards said second position because of the difference between the pressures at said two inputs.

16. Mine according to claim 15, further comprising a pressure accumulator connected to said direct action input of said distributor device and adapted to store pressure energy when said pressure is increasing and to restore said pressure energy when said pressure subsequently decreases.

* * * * *